US006736333B2

(12) United States Patent
Binder et al.

(10) Patent No.: US 6,736,333 B2
(45) Date of Patent: May 18, 2004

(54) ROTOR NOZZLE, IN PARTICULAR, FOR A HIGH-PRESSURE CLEANING DEVICE

(75) Inventors: Juergen Binder, Leutenbach (DE); Thomas Hofer, Auenwald (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 10/377,081

(22) Filed: Feb. 28, 2003

(65) Prior Publication Data

US 2003/0178505 A1 Sep. 25, 2003

Related U.S. Application Data

(63) Continuation of application No. PCT/EP01/10546, filed on Sep. 13, 2001.

(30) Foreign Application Priority Data

Sep. 22, 2000 (DE) ..... 100 47 049

(51) Int. Cl.[7] ..... B05B 3/00

(52) U.S. Cl. ..... 239/225.1; 239/227; 239/237; 239/251; 239/263; 239/381

(58) Field of Search ..... 239/227, 237, 239/240, 251, 261, 263, 264, 225.1, 380–383

(56) References Cited

U.S. PATENT DOCUMENTS 5,217,166 A * 6/1993 Schulze et al. ..... 239/227
5,265,806 A * 11/1993 Ferrarini ..... 239/251
5,328,097 A * 7/1994 Wesch et al. ..... 239/243
5,395,053 A * 3/1995 Frech ..... 239/227
6,250,566 B1 6/2001 Jager

FOREIGN PATENT DOCUMENTS

| | | |
|---|---|---|
| DE | 43 19 743 | 12/1994 |
| DE | 197 09 120 | 9/1998 |
| DE | 198 32 568 | 1/2000 |
| DE | 199 00 595 | 7/2000 |
| EP | 0 974 399 | 1/2000 |
| IT | BZ 94 A 000034 | 12/1994 |

* cited by examiner

*Primary Examiner*—Dinh Q. Nguyen
(74) *Attorney, Agent, or Firm*—Barry R. Lipsitz; Douglas M. McAllister

(57) ABSTRACT

The invention provides a rotor nozzle, comprising a casing and a rotor body arranged therein. The rotor body has a flow-through channel and a spherical bearing part in a step bearing surrounding an exit opening of the casing. An end part closes the casing and has several selectively closable passages arranged therein which open from an inlet side into the interior of the casing or into flow channels in the casing leading to additional outlets. The end part widens in steps from the interior to the inlet side, and is inserted into a stepped receiving opening. A seal is provided between the end part and the inner wall of the receiving opening. An outlet for a passage of the end part is arranged in the area of at least one step and a flow channel begins in the casing in the area of this step.

25 Claims, 10 Drawing Sheets

ROTOR NOZZLE, IN PARTICULAR, FOR A HIGH-PRESSURE CLEANING DEVICE

The present disclosure relates to the subject matter disclosed in International application No. PCT/EP01/10546 of Sep. 13, 2001, which is incorporated herein by reference in its entirety and for all purposes.

BACKGROUND OF THE INVENTION

The invention relates to a rotor nozzle, in particular, for a high-pressure cleaning device, comprising a casing and a rotor body which is arranged therein, has a flow-through channel and is accommodated with a spherical bearing part in a step bearing which surrounds an exit opening of the casing, an end part which closes the casing on the side located opposite the step bearing and in which several, selectively closable passages are arranged which open from an inlet side into the interior of the casing accommodating the rotor body or into flow channels in the casing which lead to additional outlets of the casing.

A rotor nozzle of this type is known, for example, from DE 43 19 743 A1. In this respect, two passages are provided in the end part which can be selectively closed or released via a spherical closure member so that liquid can be introduced either centrally into the interior closed by the casing or tangentially into it.

For reasons of space, it is extremely difficult to accommodate more than these two passages in the end part. In addition, it is hardly possible to provide additional possibilities for discharging the liquid, for example, via stationary compact nozzles or flat spray nozzles without increasing the diameter of the rotor nozzle.

The object of the invention is to design a generic rotor nozzle such that the possibility is created for additional passages and discharge points for the liquid whilst retaining a small constructional size for such a rotor nozzle.

SUMMARY OF THE INVENTION

This object is accomplished in accordance with the invention, for a rotor nozzle of the type described at the outset, in that the end part widens in steps in its longitudinal direction leading from the interior of the casing to its inlet side, that the end part is inserted into a stepped receiving opening in the casing which widens correspondingly, that a seal is provided between end part and the inner wall of the receiving opening above and below a respective step of the end part, that an outlet for a passage of the end part is arranged in the area of at least one step and that a flow channel begins in the casing in the area of this step.

This design makes it possible to accommodate additional passages in the end part in addition to the known, central passages and to connect these in a space-saving manner to flow channels which are incorporated in the wall of the casing and extend next to the interior of the casing in the casing itself, i.e., in the casing wall and lead to additional discharge points for the liquid. As a result, the constructional size of the rotor nozzle is not, altogether, increased; the space available is, on the contrary, utilized in an optimum manner as a result of the stepped design of the end part and the connection of the passages to the flow channels in the area of the steps.

It may be provided, in particular, for the outlets of the passages arranged in the area of the steps to exit from the end part transversely to the longitudinal direction at the level of the step.

The flow channels may extend in longitudinal direction in the casing in the area of the steps, i.e., abut on the interior on their outer side. As a result of the arrangement of the flow channels parallel to the longitudinal direction of the casing, a minimal space requirement is generated in a radial direction; since the flow channels are arranged in the area of the step, they do not project in a radial direction beyond the widest part of the end part but rather are located within the contour of the end part.

It is favorable when the steps of the end part and the steps of the casing are offset slightly relative to one another in longitudinal direction so that a gap results between them which provides a flow connection between the outlet of a passage and the beginning of a flow channel.

A particularly preferred development results when steps following one another in longitudinal direction are arranged on oppositely located sides of the end part. The space above the steps can then be used on both sides of the end part for accommodating the flow channel and so an optimum utilization of space results.

In a particularly preferred embodiment, it is provided for the sections of the end part separated from one another by the steps to each be of a circular-cylindrical design. This end part is then inserted in a sealed manner into sections of the receiving opening which are of a correspondingly circular-cylindrical shape.

The longitudinal axes of the circular-cylindrical sections, which adjoin a section located therebetween on both sides, are preferably arranged so as to be concentric to one another whereas the longitudinal axis of the section located therebetween is, in comparison, offset to the side. As a result, steps automatically result in the area of transition and these are arranged essentially on oppositely located sides of the end part.

In this respect, it is advantageous when the diameter of the section located therebetween is selected such that this merges into the adjoining, broader section without any steps on its side located opposite the step.

It is also favorable when the diameter of the narrower section is selected such that this merges into the section located therebetween without any steps on its side located opposite the step. In this way, the steps extend only over part of the circumference of the end part and become ever narrower towards the side located opposite.

In order to seal the end part in relation to the inner wall of the receiving bore, O-ring seals can be provided which are preferably inserted into circumferential grooves of the end part.

In a modified embodiment, it is provided for welding seams connecting the end part to the casing to be provided for sealing the end part in relation to the inner wall of the receiving bore. For example, this may be a weld connection, which is produced by way of a very localized application of ultrasonic energy, when a thermoplastic material is used for the end part and for the casing.

The flow channels in the casing preferably lead to nozzle members which form an outlet for the flow channels, for example, flat spray nozzles or atomizing nozzles for discharging a cleaning chemical.

These nozzle members may preferably be inserted into receiving recesses of the casing in a sealed manner.

It is particularly advantageous when two such flow channels are provided in the casing and they are located diametrically opposite one another.

A passage which enters the interior centrally parallel to the longitudinal direction may be provided in the end part.

In addition, an additional passage may be connected to channels which enter the interior with a tangential component remote from the central axis of the interior in such a manner that the liquid in the interior is caused to rotate about the central axis of the interior. As a result of this rotation, the rotor body mounted in the interior is also taken along and moves on a conical path.

These channels may be incorporated directly in the end part but in another preferred embodiment it is provided for the channels to be arranged in a cap which is placed in a sealed manner on the end part and covers a hollow space therein which communicates with a passage and with the channels.

In a preferred embodiment it is provided for the passages to enter the inlet side of the end part parallel to the longitudinal direction.

A receiving chamber for closure members, which close all the respective passages except for one, may be positioned in front of the inlet side of the end part.

These closure members are preferably spheres which can be mounted in the receiving chamber so as to be freely movable and are moved in front of the inlets to the corresponding passages, which they then close, with a corresponding orientation of the rotor nozzle and due to the action of the liquid, wherein the number of passages is always greater by one than the number of closure members.

It is favorable when the closure members are tensioned by springs against oppositely located entry openings of the passages.

A liquid connection can open into the receiving chamber, the end part and the casing being mounted on this liquid connection in a sealed manner and so as to be rotatable about the longitudinal axis of the end part. The user can, therefore, decide, when the supply of liquid is switched off, which of the passages are closed by a closure member and which passage remains open simply by turning the rotor nozzle in relation to the end part.

In a preferred embodiment, the casing and the end part inserted into it are covered by a hood.

This hood can secure the end part and the casing to a liquid connection so as to be axially non-displaceable and rotatable about the longitudinal axis of the end part.

The following description of preferred embodiments of the invention serves to explain the invention in greater detail in conjunction with the drawings.

DETAILED DESCRIPTION OF THE INVENTION

Figure 4:
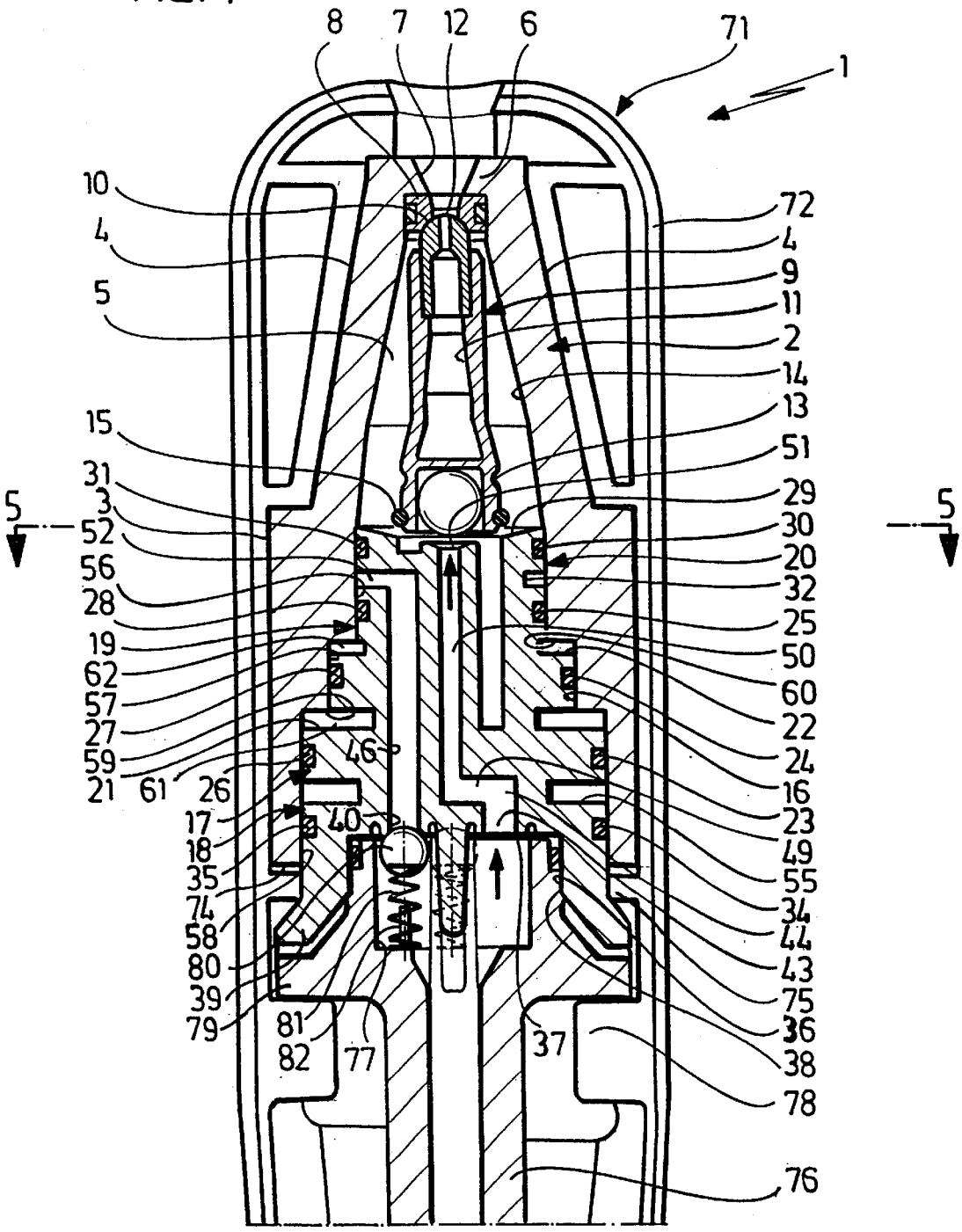
FIG. 4: shows a longitudinal sectional view of a rotor nozzle with an end part according to FIGS. 1 to 3 with an open, central passage.

The rotor nozzle 1 illustrated, for example, in FIG. 4 has a casing 2 which is of a circular-cylindrical design in a lower area 3 whereas its oppositely located side surfaces 4 are inclined towards one another towards the top so that, altogether, an elongated, approximately oval cross section results.

In its upper area between the side surfaces 4, the casing 2 surrounds an interior 5 which is in the shape of a truncated cone and in the end surface 6 of which, which is arranged at the upper end of the casing 2, an outlet opening 7 is arranged. In this area, an annular step bearing 8, which surrounds the outlet opening 7 and in which an elongated rotor body 9 with a bearing end 10 of a spherical design is supported, is inserted into the end surface 6 in a sealed manner. This rotor body 9 has on its interior a flow-through channel 11 which communicates with the interior 5 at its lower end via openings 10*a* and which opens into a nozzle opening 12 in the bearing end 10 designed as a nozzle member.

Figure 6:
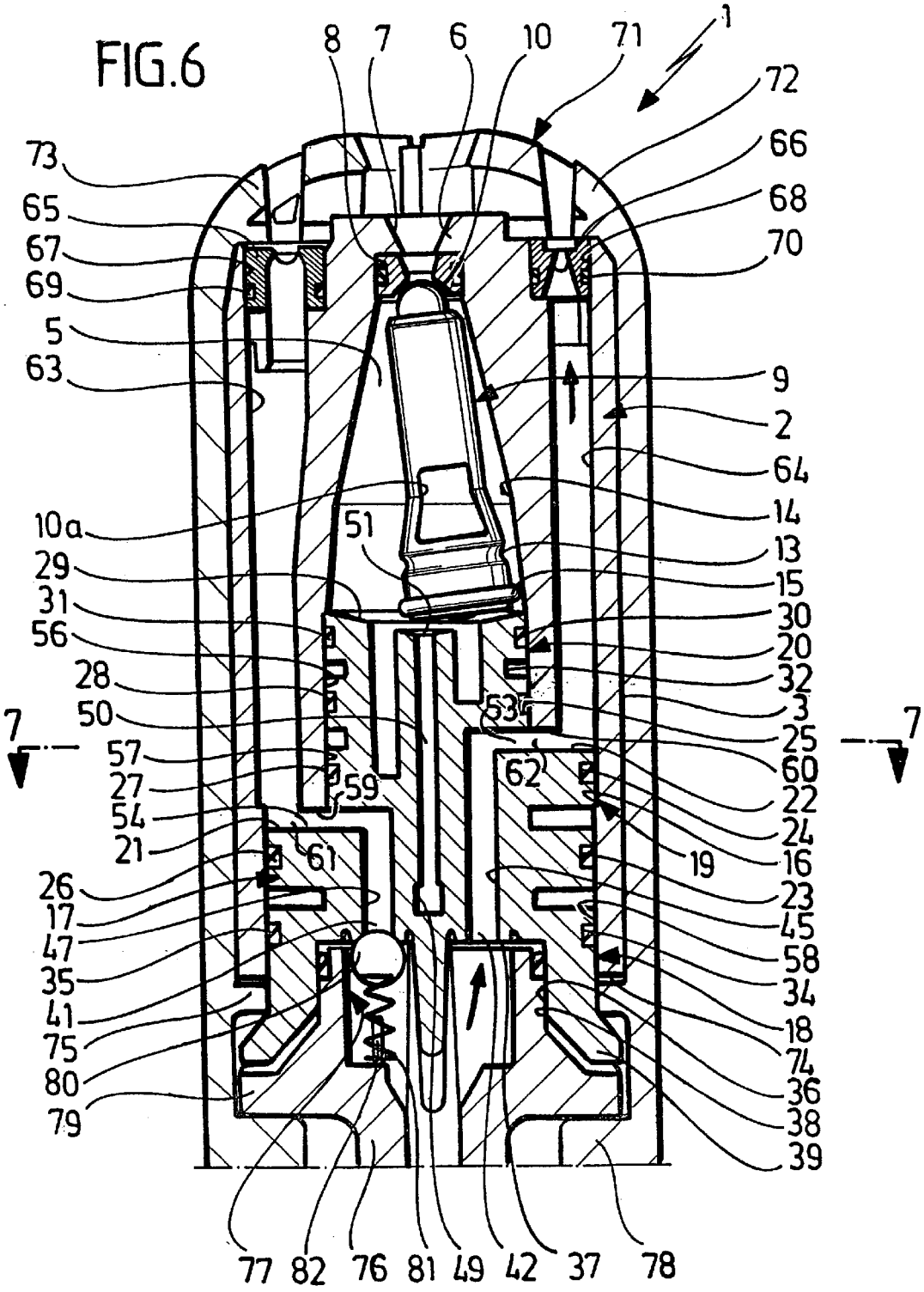
FIG. 6: shows a view similar to FIG. 4 with a sectional direction turned through 90° and an open passage for an additional nozzle member.
Figure 7:
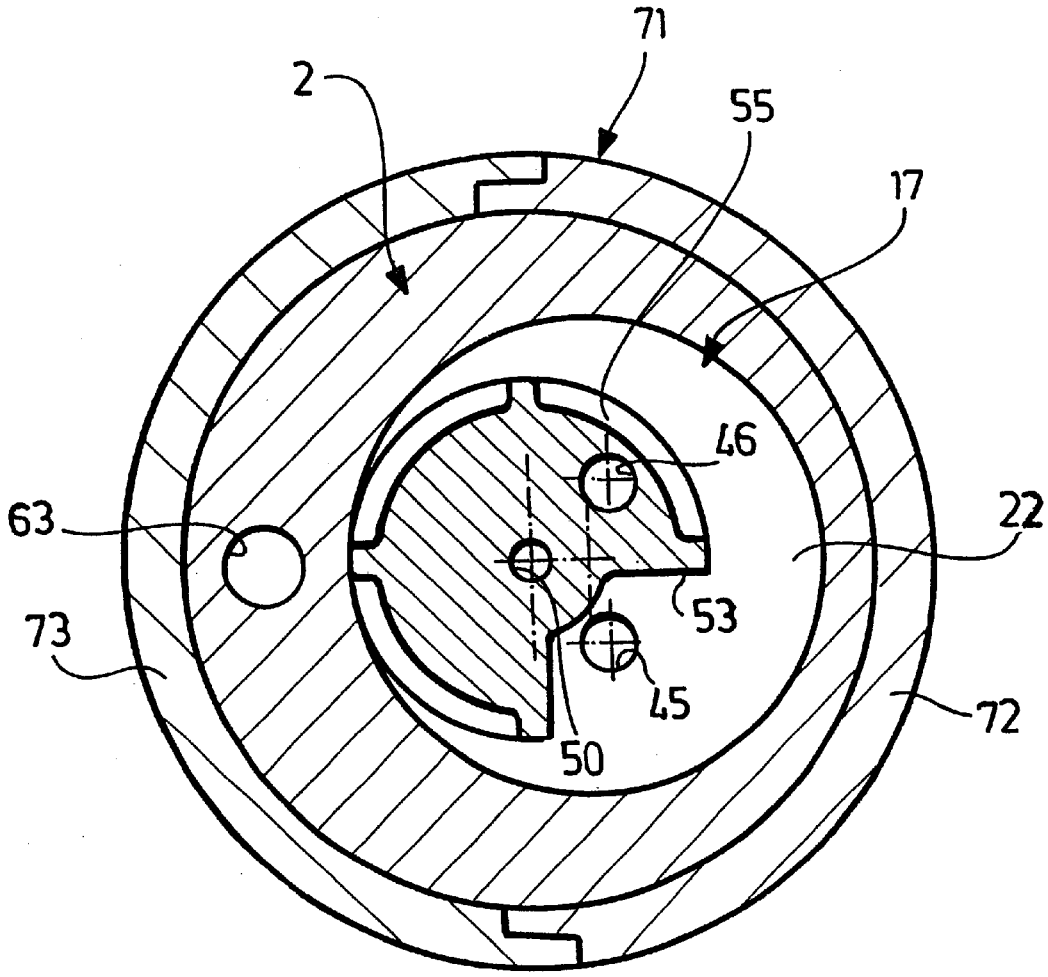
FIG. 7: shows a sectional view along line 7—7 in FIG. 6.

The rotor body 9 is mounted in the step bearing 8 so as to be freely rotatable about its longitudinal axis and so as to wobble such that it can abut with its rear end area 13 on the conical inner wall 14 of the interior 5, wherein it is supported on this inner wall 14 via an O-ring 15 which surrounds its rear end area 13 (FIG. 6).

A receiving opening 16, which is positioned in front of the interior 5 of the casing 2, is arranged in the cylindrical area 3 of the casing 2. An end part 17, which closes the interior 5 on the side located opposite the step bearing 8, is inserted into this receiving opening 16 in a sealed manner.

Figure 1:
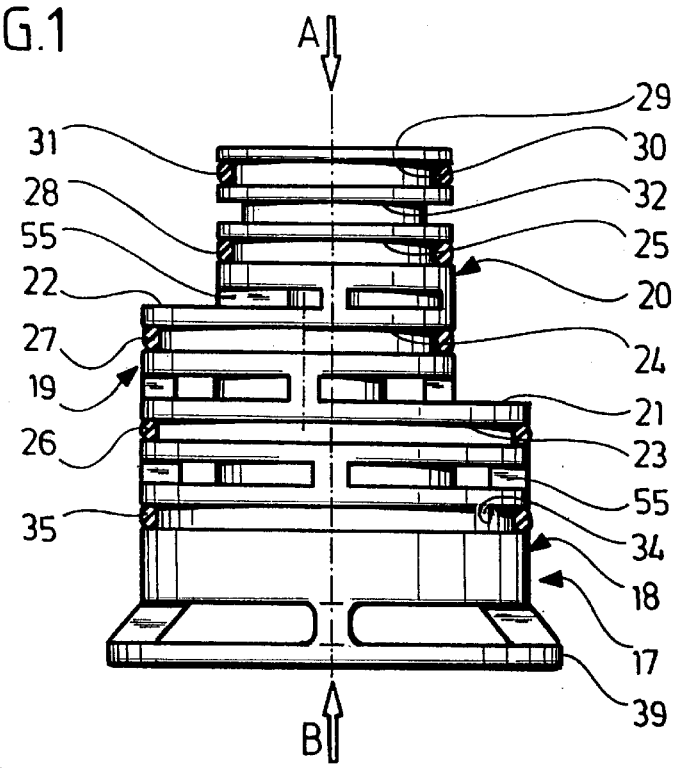
FIG. 1: shows a side view of a first preferred embodiment of an end part.
Figure 2:
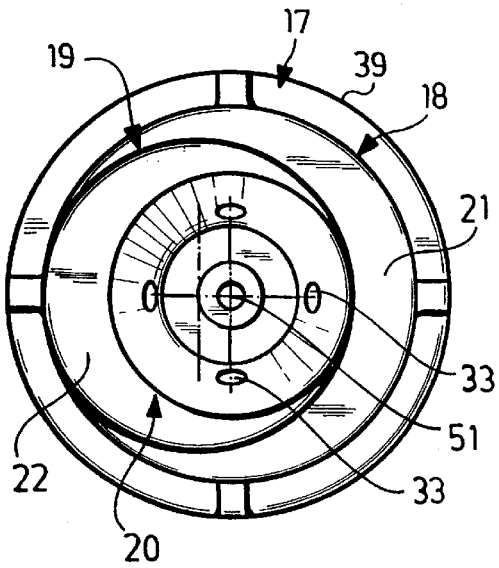
FIG. 2: shows a plan view of the end part of FIG. 1 in the direction of arrow A.
Figure 3:
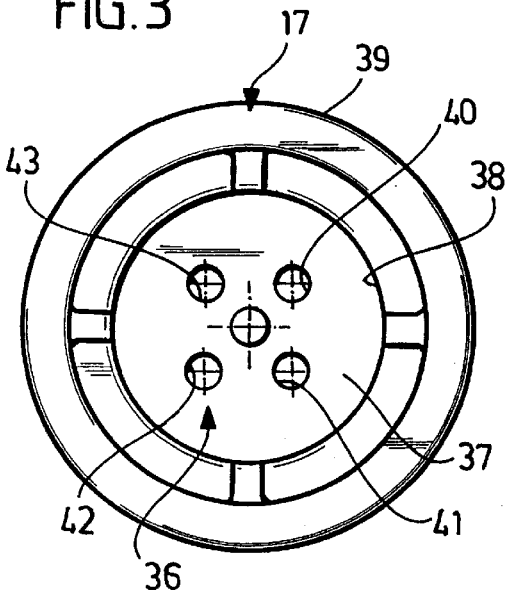
FIG. 3: shows a plan view of the end part of FIG. 1 in the direction of arrow B.

The end part 17 comprises a circular-cylindrical base section 18, a central section 19 of a circular-cylindrical design adjoining thereto and an end section 20 of a circular-cylindrical design adjoining thereto, wherein the external diameter of the central section 19 is between the external diameters of the larger base section 18 and the smaller end section 20 (FIGS. 1 and 2). The base section 18 and the end section 20 are arranged concentrically to one another, the central axis of the central section 19 is offset laterally in relation to their central axis such that the central section 19 merges into the base section 18 without any steps on one side so that a sickle-shaped step 21 is formed on the side located opposite. The external diameter of the end section 20 is selected such that no step results in the transition to the central section 19 on the side of the step 21 but, on the other hand, a sickle-shaped step 22 likewise results on the side located opposite. The steps 21 and 22 are, therefore, located diametrically opposite one another and are offset in relation to one another in longitudinal direction of the end part 17.

O-ring seals 26, 27 and 28 are inserted into circumferential grooves 23, 24 and 25, respectively, of the end part 17 above and below the respective steps 21 and 22, these seals projecting slightly in a radial direction beyond the outer circumference of the sections of the end part.

Figure 5:
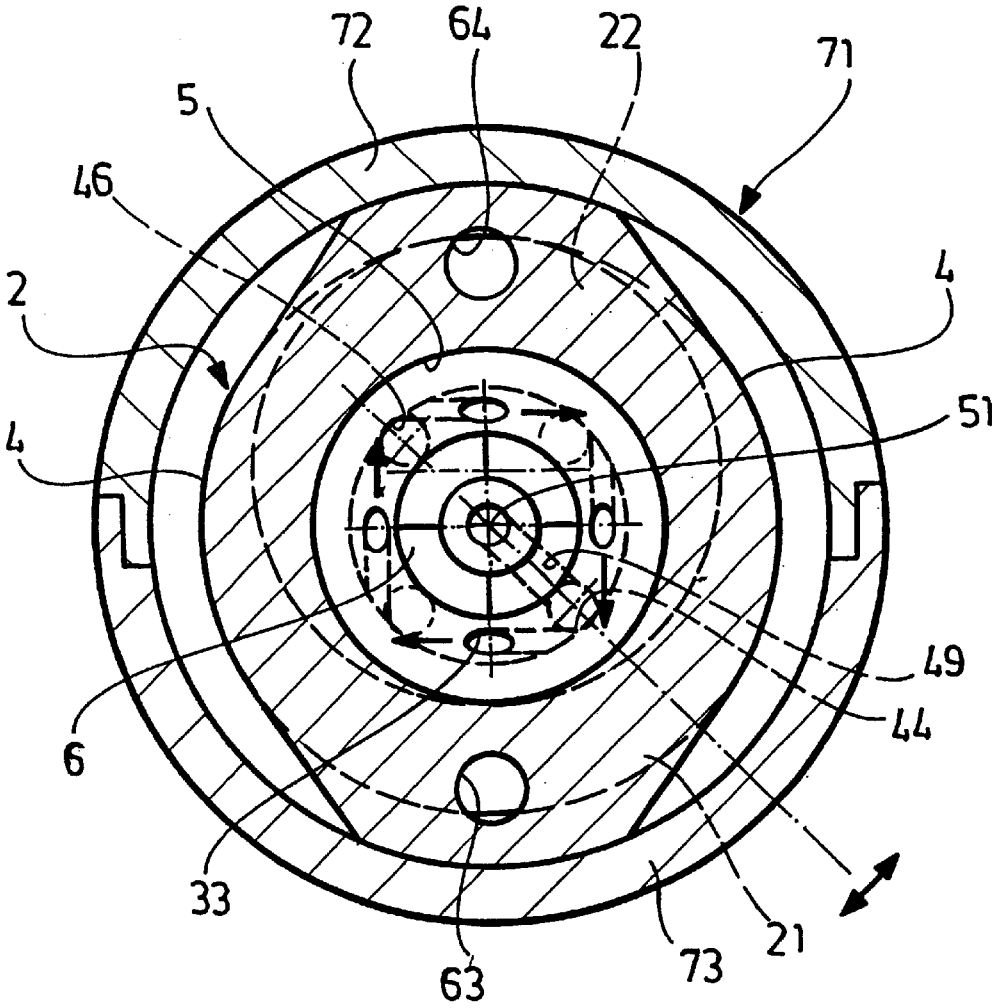
FIG. 5: shows a sectional view along line 5—5 in FIG. 4.
Figure 8:
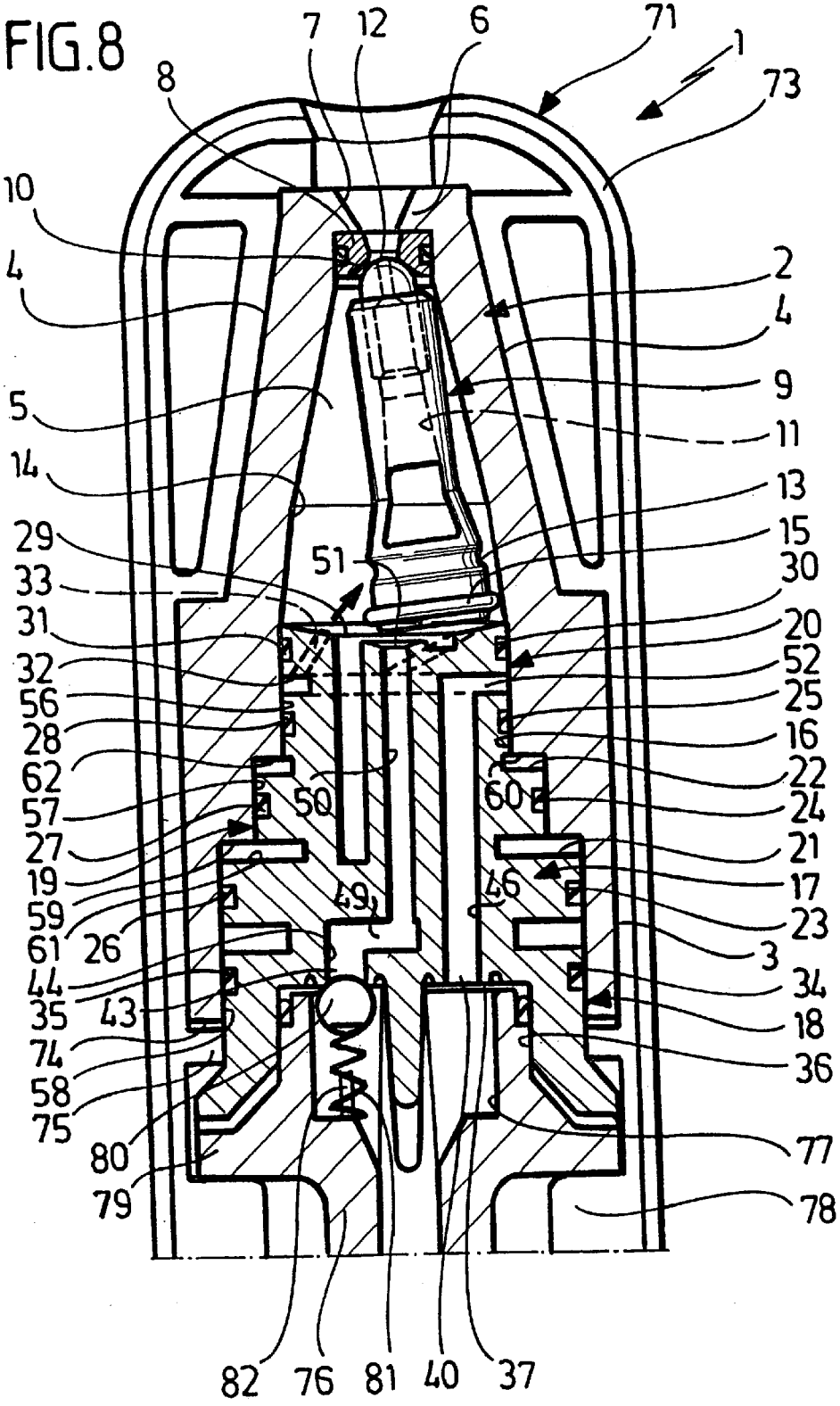
FIG. 8: shows a view similar to FIG. 4 with an open passage for a tangential entry of liquid into the interior.
Figure 9:
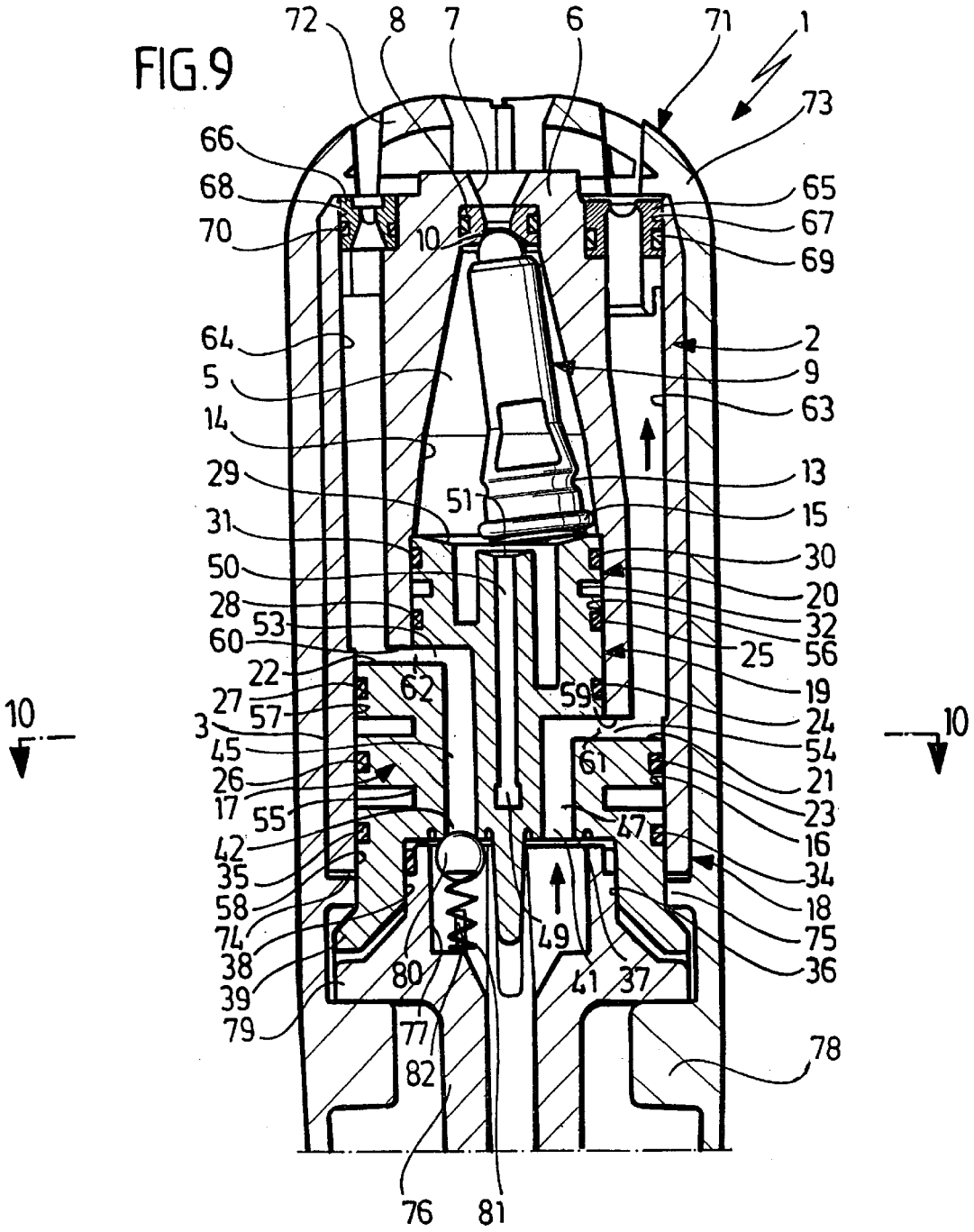
FIG. 9: shows a view similar to FIG. 6 with an open passage for an additional nozzle member.
Figure 10:
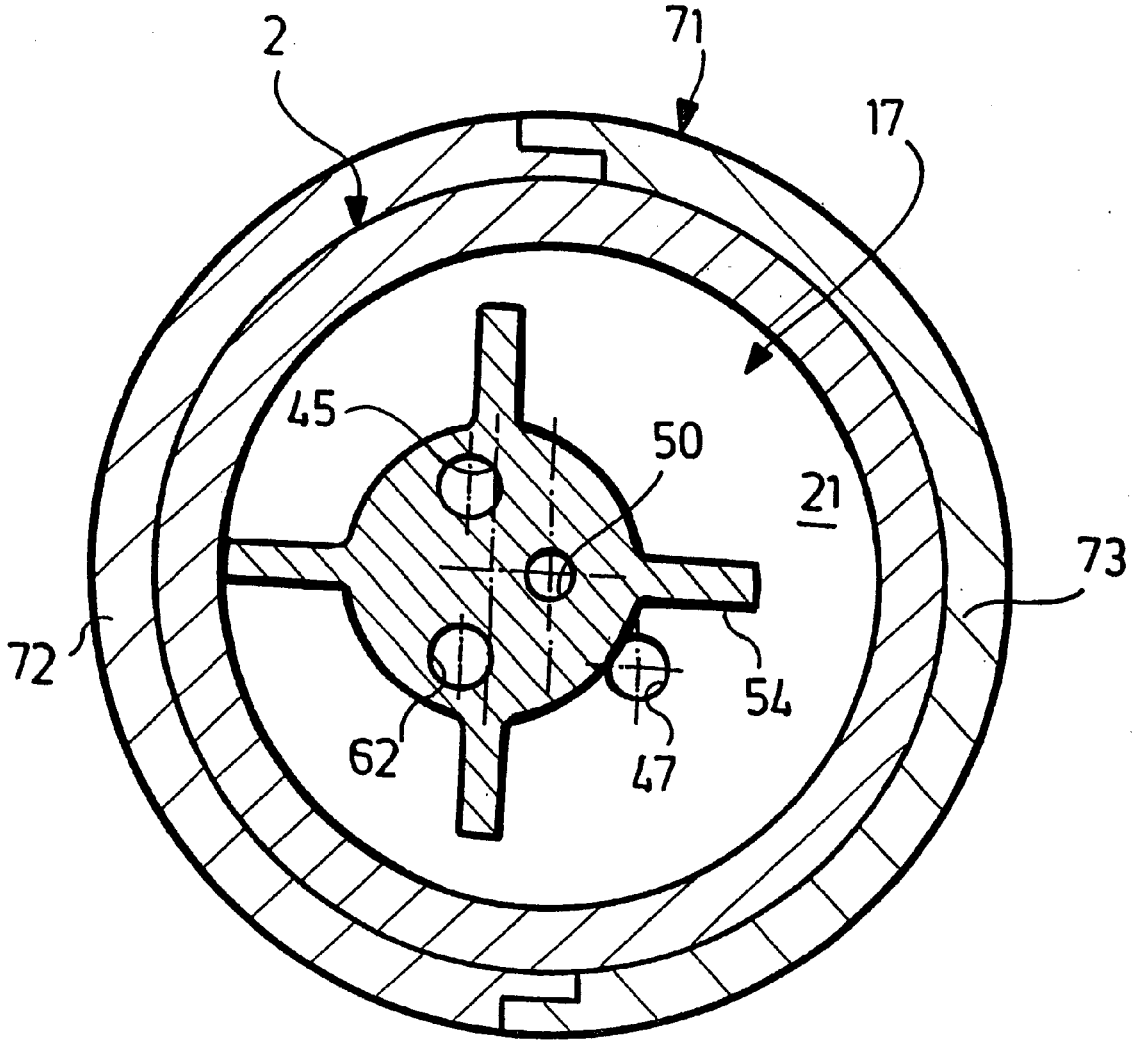
FIG. 10: shows a sectional view along line 10—10 in FIG. 9.

An additional O-ring seal 31 is inserted into a circumferential groove 30 in the end section 20 immediately adjacent to the upper end surface 29 of the end part 17 and an additional circumferential groove 32 is located in the end section 20 between this circumferential groove 30 and the circumferential groove 25 but no O-ring seal is inserted into it. This circumferential groove 32 is connected to the interior 5 via channels 33 extending with a tangential component in circumferential direction; the channels 33 begin in this circumferential groove 32 and enter the interior 5 at the end surface 29 extending at an angle in circumferential direction (FIGS. 5 and 8).

An additional circumferential groove 34, which likewise accommodates an O-ring seal 35, is located beneath the circumferential groove 23 at a distance to it.

An annular receiving chamber 36 with a flat base surface 37 and a side wall 38 circular in cross section is arranged at the end of the base section 18 located opposite the end surface 29. At the lowest end, the base section 18 bears an annular shoulder 39 projecting outwards.

Four entry openings 40, 41, 42 and 43 for four channel-like passages 44, 45, 46 and 47, respectively, which are arranged in the end part 17 parallel to the longitudinal direction thereof immediately adjoining the receiving chamber 36, are located in the base surface 37, respectively offset relative to one another through an angle of 90°.

A first passage 44 is connected via a line section 49 projecting radially inwards to a line section 50 which extends parallel to the longitudinal direction of the end part 17 and concentrically to the base section 18 and the end section 20 and exits into the interior 5 through a central outlet opening 51 in the end surface 29.

An additional passage 46, which is located diametrically opposite the passage 44, extends parallel to the longitudinal direction of the end part 17 through it as far as the level of the circumferential groove 32 and opens into this circumferential groove 32 via a line section 52 which is directed radially outwards (FIG. 4).

An additional passage 45, which is arranged between the passages 44 and 46, extends parallel to the longitudinal direction of the end part 17 as far as the level of the step 22 and exits via a radial line section 53. Finally, an additional passage 47 extends diametrically opposite to this passage 45 parallel to the longitudinal direction of the end part 17 as far as the level of the step 21 and exits via a radial line section 54, likewise at the level of the step 21 (FIG. 6).

The entire end part 17 is produced from plastic in one piece, with the exception of the O-ring seals, its mass is reduced by a row of recesses 55.

The receiving opening 16 of the casing 2 is shaped essentially complementary to the outer contour of the end part 17, i.e., it has a circular-cylindrical upper section 56 adjacent to the interior 5, a central, circular-cylindrical section 57 adjoining thereto and a lower, circular-cylindrical section 58, wherein the upper section 56 and the lower section 58 are arranged concentrically to one another whereas the central section 57 is offset laterally in comparison with it.

As a result, a step 59 is also formed between the lower section 58 and the central section 57 and a step 60 between the central section 57 and the upper section 56.

These steps 59 and 60 are located directly opposite the steps 21 and 22 but maintain a slight distance in relation to them in longitudinal direction of the end part 17 so that a gap 61 and 62, respectively, results between the steps and the radial line sections 54 and 53, respectively, open into the respective gaps.

The O-ring seals 26, 27 and 28 as well as the O-ring seals 31 and 35 seal the end part 17 inserted into the receiving opening 16 in relation to the inner wall of the receiving opening 16 in sections, the O-ring seals 26 and 27, for example, in the area of the step 21 and the O-ring seals 27 and 28 in the area of the step 22.

Two flow channels 63 and 64 extending parallel to the longitudinal direction are arranged in the casing 2 next to the interior 5 on sides located diametrically opposite one another, pass with their lower ends through the respective steps 59 and 60 and open into the respective, adjoining gap 61 and 62. Proceeding from these gaps 61 and 62, the flow channels 63 and 64 lead to nozzle members 65 and 66, respectively, which are inserted into corresponding receiving recesses 67 and 68, respectively, at the upper end of the casing 2 and are sealed in relation to the receiving recesses 67 and 68, respectively, by means of O-ring seals 69 and 70. The nozzle members 65 and 66 have outlet openings of different shapes which are suitable, for example, for generating a fan jet and a spray mist.

The nozzle members 65 and 66 are held in the receiving recesses 67 and 68 by a hood 71 which covers the casing 2 and consists of two assembled half shells 72, 73. These half shells surround the casing 2 on both sides and engage over the lower edge 74 of the casing 2 with an annular shoulder 75 which projects inwards.

A supply pipe 76 bears at its end a pot-shaped extension 77 which protrudes in a sealed manner into the receiving chamber 36 of the end part 17 and, as a result, closes this on all sides. The end part 17 and, with it, the casing 2 are rotatable relative to the pot-shaped extension 77 about the longitudinal axis of the supply pipe 76 and, therefore, the central axis of the rotor nozzle; in axial direction, the pot-shaped extension 77 is secured relative to the end part 17 in that the hood 71, with an additional annular shoulder 78 projecting inwards, engages behind a flange-like extension 79 which surrounds the pot-shaped extension 77.

Three spherical valve members 80 are arranged in the interior of the receiving chamber 36 and are each tensioned by a helical spring 81 against the base surface 37 of the receiving chamber 36. The helical springs 81 are secured on the pot-shaped extension 77 by means of projections 82 in such a manner that they are located directly opposite three of the four respective passages 44, 45, 46, 47 in a specific angular position of the end part 17 relative to the supply pipe 76 and close them due to the action of the helical springs 81. Only one of the passages therefore remains open and this can be selected by turning the end part 17 in a suitable manner relative to the supply pipe 76.

When the passage 46 is opened (FIG. 8), liquid passes via this into the circumferential groove 32 and is introduced into the interior 5 from this groove through the tangential channels 33 in such a manner that a batch of liquid rotating about the longitudinal axis of the interior 5 is generated in this interior. This takes the rotor body 9 along with it which abuts, thereupon, with its O-ring 15 on the inner wall 14 of the interior 5 and rolls along this interior, i.e., the rotor body 9 moves along a conical surface and, therefore, discharges liquid passing through the flow-through channel 11 in the form of a compact jet circulating on a conical surface.

When only the passage 44 is opened, the liquid enters the interior 5 via the central line section 50 centrally and parallel to the central axis; as a result, the rotor body 9 is centered, remains permanently in its central position and, in this way, supplies a compact jet not circulating on a conical surface (FIG. 4).

If the passages 45 or 47 are opened, the liquid passes to the associated nozzle members 66 and 65, respectively, and is discharged via these nozzle members according to the geometry of them, for example, as a fan jet or as a spray mist.

The selection is made solely by means of a rotation of the entire rotor nozzle in relation to the supply pipe 76 and can, therefore, be brought about in the most simple of ways when a supply of liquid is switched off.

The rotor nozzle 1 described is also very easy to mount. First of all, the step bearing 8 is pushed into the casing 2; in addition, the rotor body 9 is inserted into the interior 5 so that its spherical bearing end 10 engages in the step bearing 8. Subsequently, the end part 17 is inserted into the receiving opening 16; this is possible only in a specific angular position since not only the receiving bore but also the end part 17 are not rotationally symmetric and, finally, the pot-shaped extension 77 is inserted into the receiving chamber 36, wherein the three spherical valve members 80 are introduced into the receiving chamber 36 such that the helical springs 81 tension them against the base surface 37 of the receiving chamber 36.

The entire unit is secured in an axial direction by the two half shells 72 and 73 being applied from the side; the half shells may, for example, be screwed to one another.

In the embodiment of FIGS. 1 to 10, the sealing of the individual sections of the end part 17 in relation to the receiving opening 16 is brought about by O-ring seals which are inserted into circumferential grooves of the end part 17.

Figure 11:
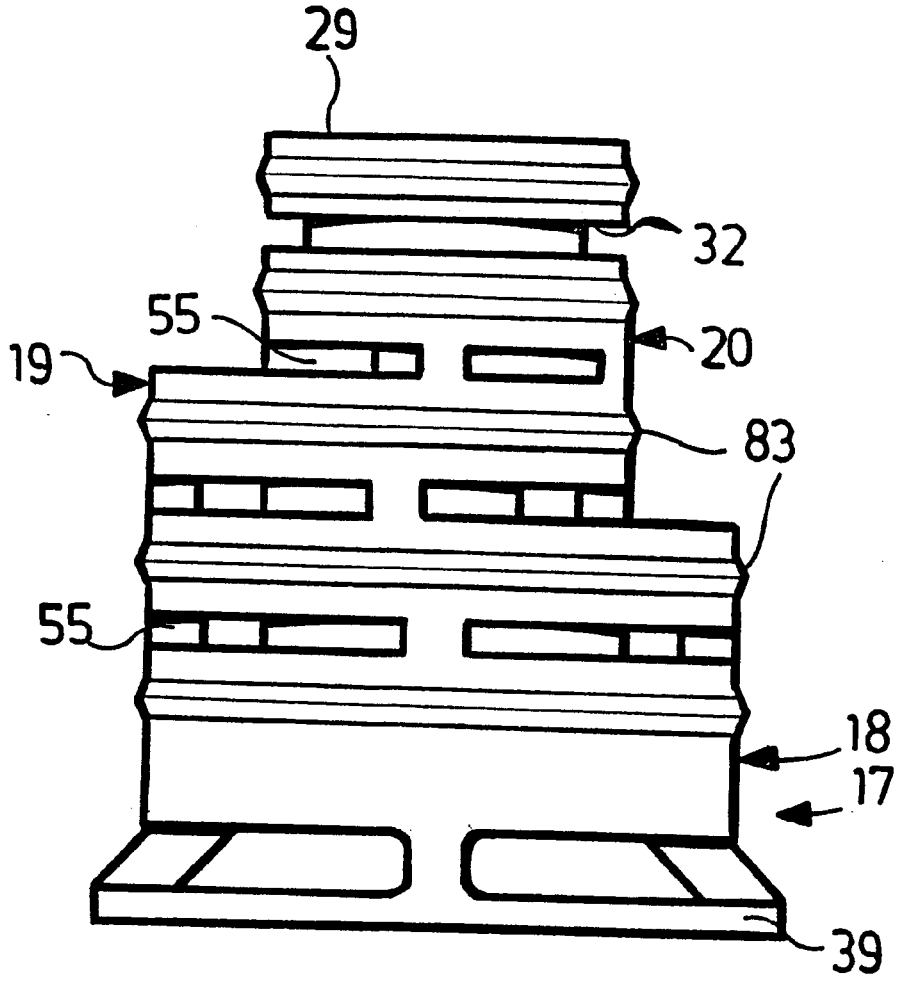
FIG. 11: shows a view similar to FIG. 1 in the case of an end part with welded ribs

In the modified embodiment of an end part 17 illustrated in FIG. 11, the circumferential grooves and the O-ring seals inserted therein are missing but the remaining construction is the same and so parts corresponding to one another have the same reference numerals. Instead of the circumferential grooves and the O-ring seals, this end part 17 of FIG. 11 has circumferential ribs 83 which project slightly outwards and which come to rest on the inner wall of the receiving opening 16 during insertion of the end part 17. These circumferential ribs 83 can be welded to the wall of the receiving opening 16; this is possible, for example, due to the fact that ultrasonic radiation is directed into the contact area between circumferential ribs 83 and the inner wall of the receiving opening 16 and this radiation melts the material which is in contact at this location due to heating and, as a result, brings about a heat seal.

Figure 12:
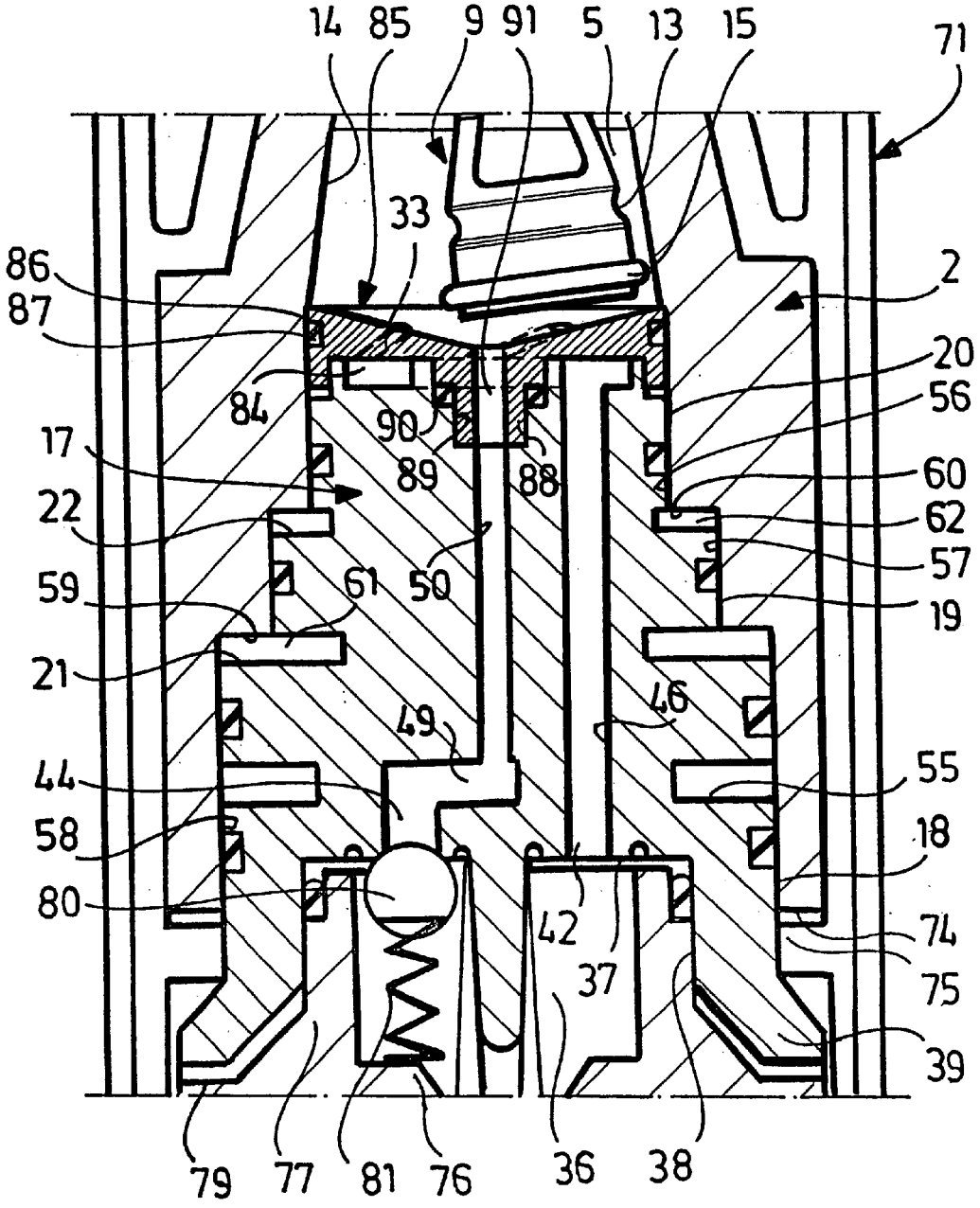
FIG. 12: shows a partial, longitudinal, sectional view of a rotor nozzle similar to FIG. 8 in the case of a modified embodiment of an end part.

In the embodiment of FIGS. 1 to 10, the end part 17 is designed in one piece. In a modified embodiment illustrated in FIG. 12, an end part 17 is used which is, to a great extent, of the same construction and so parts corresponding to one another have the same reference numerals. In this embodiment, the circumferential grooves 30 with the inserted O-ring seal 31 and the circumferential groove 32 are, however, missing; instead, the passage 46 opens into an annular groove 84 in the end face of the end part 17, this groove opening in the direction of the interior 5 and, for its part, being covered towards the interior 5 by a plate-like end cap 85. This end cap 85 is placed onto the end part 17 at its end face and is sealed in relation to the receiving opening 16 by means of an outer circumferential groove 86 and an O-ring seal 87 arranged therein. Channels 33 directed tangentially in circumferential direction are arranged in the end cap 85 and connect the annular groove 84 to the interior 5. In addition, a central projection 88 of the end cap 85 protrudes into a corresponding recess 89 in the end part 17 and is sealed in relation to the end part 17 by an inserted O-ring seal 90. A continuous channel 91, which connects the line section 50 to the interior 5 of the casing 2, is located in the projection 88.

The rest of the construction corresponds completely to that of the embodiment of FIGS. 1 to 10.

What is claimed is:

1. A rotor nozzle for a high-pressure cleaning device, comprising:

a casing, a rotor body arranged in said casing, said rotor body having a flow-through channel and being accommodated with a spherical bearing part in a step bearing surrounding an exit opening of the casing, an end part closing the casing on the side located opposite the step bearing, several selectively closable passages arranged in said end part, said passages opening into an interior of the casing accommodating the rotor body or into first flow channels in the casing from an inlet side, said first flow channels leading to additional outlets of the casing, the end part widening in steps in a longitudinal direction leading from the interior of the casing to said inlet side, the end part being inserted into a stepped receiving opening widening correspondingly in the casing, a seal provided between the end part and the inner wall of the stepped receiving opening at locations above and below a respective step of the end part, an outlet for a passage of the end part arranged in the area of at least one of said steps, and a second flow channel begins in the casing in the area of said at least one step.

2. A rotor nozzle as defined in claim 1, wherein the outlets of the passages arranged in the area of the steps exit from the end part transversely to the longitudinal direction at the level of the steps.

3. A rotor nozzle as defined in claim 1, wherein the first flow channels extend in longitudinal direction in the casing in the area of the steps.

4. A rotor nozzle as defined in claim 1, wherein the steps of the end part and the steps of the casing are offset slightly relative to one another in a longitudinal direction so that a gap results between them, said gap providing a flow connection between the outlet of a passage and the beginning of one of said first flow channel.

5. A rotor nozzle as defined in claim 1, wherein steps following one another in longitudinal direction are arranged on oppositely located sides of the end part.

6. A rotor nozzle as defined in claim 1, wherein sections of the end part separated from one another by the steps are each of a circular-cylindrical design.

7. A rotor nozzle as defined in claim 6, wherein longitudinal axes of the circular-cylindrical sections adjoining a central section located therebetween on both sides are arranged so as to be concentric to one another whereas a longitudinal axis of the central section is offset laterally in comparison to the longitudinal axes of the circular-cylindrical sections.

8. A rotor nozzle as defined in claim 7, wherein:

the circular cylindrical sections having concentric longitudinal axes comprise a broad base section and a narrow end section;

a diameter of the central section is selected such that this central section merges into the base section without any steps on its side located opposite the step.

9. A rotor nozzle as defined in claim 7, wherein a diameter of the end section is selected such that this end section merges into the central section without any steps on its side located opposite the step.

10. A rotor nozzle as defined in claim 1, wherein O-ring seals are provided for sealing the end part in relation to the inner wall of the stepped receiving opening.

11. A rotor nozzle as defined in claim 1, wherein welding seams connecting the end part to the casing are provided for sealing the end part in relation to the inner wall of the stepped receiving opening.

12. A rotor nozzle as defined in claim 1, wherein the first flow channels lead in the casing to nozzle members forming an outlet for the first flow channels.

13. A rotor nozzle as defined in claim 12, wherein the nozzle members are inserted in a sealed manner into receiving recesses of the casing.

14. A rotor nozzle as defined in claim 1, wherein said first flow channels comprise two flow channels which are provided in the casing, said two flow channels being located diametrically opposite one another.

15. A rotor nozzle as defined in claim 1, wherein a passage enters the interior centrally parallel to the longitudinal direction.

16. A rotor nozzle as defined in claim 1, wherein a passage is connected to channels entering the interior with a tangential component remote from a central axis of said interior in such a manner that the liquid in the interior is caused to rotate about the central axis of the interior.

17. A rotor nozzle as defined in claim 16, wherein the channels are arranged in a cap placed in a sealed manner on the end part and covering a hollow space therein communicating with a passage and with the channels.

18. A rotor nozzle as defined in claim 1, wherein the passages enter the inlet side of the end part parallel to the longitudinal direction.

19. A rotor nozzle as defined in claim 1, wherein a receiving chamber for closure members is positioned in front of the inlet side of the end part, said closure members closing all the respective passages except for one of said passages.

20. A rotor nozzle as defined in claim 19, wherein the closure members are spheres.

21. A rotor nozzle as defined in claim 19, wherein the closure members are tensioned by springs against oppositely located entry openings of the passages.

22. A rotor nozzle as defined in claim 19, wherein a liquid connection opens into the receiving chamber, the end part and the casing being mounted on said liquid connection in a sealed manner and so as to be rotatable about the longitudinal axis of the end part.

23. A rotor nozzle as defined in claim 1, wherein the casing and the end part are covered by a hood.

24. A rotor nozzle as defined in claim 23, wherein the hood secures the end part and the casing on a liquid connection so as to be axially non-displaceable and rotatable about a longitudinal axis of the end part.

25. A rotor nozzle as defined in claim 23, wherein the hood comprises two half shells.

* * * * *